US007895833B2

(12) United States Patent
Kajita et al.

(10) Patent No.: US 7,895,833 B2
(45) Date of Patent: Mar. 1, 2011

(54) HYDRAULIC DRIVE APPARATUS

(75) Inventors: Yusuke Kajita, Ushiku (JP); Kouji Ishikawa, Niihari-gun (JP); Hideo Karasawa, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 722 days.

(21) Appl. No.: 10/567,583

(22) PCT Filed: Aug. 5, 2004

(86) PCT No.: PCT/JP2004/011564

§ 371 (c)(1),
(2), (4) Date: May 16, 2008

(87) PCT Pub. No.: WO2005/015029

PCT Pub. Date: Feb. 17, 2005

(65) Prior Publication Data

US 2008/0223205 A1 Sep. 18, 2008

(30) Foreign Application Priority Data

Aug. 8, 2003 (JP) ..... 2003-290485

(51) Int. Cl.
*F16D 31/02* (2006.01)
*F15B 13/07* (2006.01)

(52) U.S. Cl. ..... 60/424; 91/520

(58) Field of Classification Search ..... 60/413, 60/414, 424; 91/515, 520
See application file for complete search history.

(56) References Cited

U.S. PATENT DOCUMENTS 5,797,310 A * 8/1998 Casey et al. ..... 60/424
6,389,953 B1 * 5/2002 Altman et al. ..... 91/515
6,898,932 B2 * 5/2005 Kajita ..... 60/424
7,059,237 B2 * 6/2006 Ioku et al. ..... 91/515
7,127,888 B2 * 10/2006 Kajita et al. ..... 60/424
7,434,394 B2 * 10/2008 Ishikawa et al. ..... 60/424

FOREIGN PATENT DOCUMENTS

JP 55-119838 A 9/1980

(Continued)

OTHER PUBLICATIONS

International Search Report (Four (4) pages) w/English translation of relevant portion, dated Sep. 28, 2004.

*Primary Examiner*—Michael Leslie
(74) *Attorney, Agent, or Firm*—Crowell & Moring LLP

(57) ABSTRACT

A hydraulic drive system is mounted on a hydraulic excavator, and is provided with a directional control valve 23 for a boom, a directional control valve 24 for an arm, a boom control device 25 for selectively controlling the directional control valve 23 for the boom, and an arm control device 26 for selectively controlling the directional control valve 24 for the arm. The directional control valves 23, 24 control a boom cylinder 6 and an arm cylinder 7, respectively, which are driven by pressure oil delivered from a main hydraulic pump 21. The hydraulic drive system is provided with a communication control unit for communicating a rod chamber **6*b* of the boom cylinder 6 and a bottom chamber 7*a* of the arm cylinder 7 with each other when a stroke of the arm control device 26** has become a predetermined amount S or greater.

8 Claims, 5 Drawing Sheets

FOREIGN PATENT DOCUMENTS

| | | | |
|---|---|---|---|
| JP | 60-179504 | A | 9/1985 |
| JP | 60-208610 | A | 10/1985 |
| JP | 05-209423 | A | 8/1993 |
| JP | 2002-031104 | A | 1/2002 |
| JP | 2002-339907 | A | 11/2002 |
| JP | 2003-120604 | A | 4/2003 |
| JP | 2003-184814 | A | 7/2003 |

* cited by examiner

HYDRAULIC DRIVE APPARATUS

TECHNICAL FIELD

This invention relates to a hydraulic drive system mounted on a construction machine such as a hydraulic excavator to permit a combined operation of plural hydraulic cylinders.

BACKGROUND ART

There have conventionally been proposed hydraulic control systems, each of which is mounted on a hydraulic excavator and has a main hydraulic pump and a boom cylinder and arm cylinder as a first hydraulic cylinder and second hydraulic cylinder driven by pressure oil delivered from the main hydraulic pump. This conventional art is provided with a directional control valve for a boom as a first directional control valve for controlling a flow of pressure oil to be fed from the main hydraulic pump to the boom cylinder, a directional control valve for an arm as a second directional control valve for controlling a flow of pressure oil to be fed from the main hydraulic pump to the arm cylinder, a boom control device as a first control device for selectively controlling the directional control valve for the boom, and an arm control device as a second control device for performing a switching control of the directional control valve for the arm, and is also provided with a communication control means for communicating a rod chamber of the boom cylinder and a bottom chamber of the arm cylinder with each other when a bottom pressure of the arm cylinder has increased to a high pressure equal to or higher than a predetermined pressure. (see, for example, JP-A-2002-339907).

DISCLOSURE OF THE INVENTION

When the bottom pressure of an arm cylinder has become high as a result of digging work or the like of earth in a combined boom-arm operation performed by feeding pressure oil to both of a bottom chamber of a boom cylinder and a bottom chamber of the arm cylinder, the above-described conventional art can effectively use pressure oil in a rod chamber of the boom cylinder, which was conventionally drained, for an acceleration of the arm cylinder in its extending direction, and can realize an improvement in the efficiency of the work.

In some work, however, the bottom pressure of the arm cylinder may not become high upon performing a combined boom-arm operation as in work involving a crowding operation of a bucket in the air. Even in such work, it is desired to realize an acceleration of the arm cylinder, that is, a second hydraulic cylinder.

With a view to meeting the above-describe desire, the present invention has as an object the provision of a hydraulic drive system which, in a combined operation to be performed by feeding pressure oil to both of bottom combers of a first hydraulic cylinder and second hydraulic cylinder, can effectively use pressure oil in a rod chamber of the first hydraulic cylinder, which was conventionally drained into a reservoir, irrespective of the level of a bottom pressure in the second hydraulic cylinder.

To achieve the above-described object, the present invention is characterized in that, in a hydraulic drive system provided with a main hydraulic pump, a first hydraulic cylinder and second hydraulic cylinder driven by pressure oil delivered from the main hydraulic pump, a first directional control valve for controlling a flow of pressure oil to be fed from the main hydraulic pump to the first hydraulic cylinder, a second directional control valve for controlling a flow of pressure oil to be fed from the main hydraulic pump to the second hydraulic cylinder, a first control device for selectively controlling the first directional control valve, and a second control device for selectively controlling the second directional control valve, the hydraulic drive system is provided with a communication control means for communicating a rod chamber of the first hydraulic cylinder and a bottom chamber of the second hydraulic cylinder with each other when a stroke of the second control device has increased to at least a predetermined amount.

According to the present invention constructed as described above, when the stroke of the second control device has increased to at least the predetermined amount upon performing a combined operation of these first hydraulic cylinder and second hydraulic cylinder by controlling the first control device and second control device to switch the first directional control valve and second directional control valve and feeding pressure oil from the main hydraulic pump to the bottom chambers of the first hydraulic cylinder and second hydraulic cylinder via the first directional control valve and second directional control valve, respectively, the communication control means is actuated to feed the pressure oil in a rod chamber of the first hydraulic cylinder to the bottom chamber of the second hydraulic cylinder. Described specifically, the pressure oil delivered from the main hydraulic pump and fed via the second directional control valve and the pressure oil fed from the rod chamber of the first hydraulic cylinder are combined and fed to the bottom chamber of the second hydraulic cylinder, and as a result, an acceleration can be achieved in the extending direction of the second hydraulic cylinder irrespective of the level of pressure oil in the bottom chamber of the second hydraulic cylinder. As described above, the pressure oil in the rod chamber of the first hydraulic cylinder, which was conventionally drained into the reservoir, can be effectively used for the selective acceleration of the second hydraulic cylinder.

The present invention can also be characterized in that in the above-described invention, the communication control means may comprise a communication line capable of communicating the rod chamber of the first hydraulic cylinder and the bottom chamber of the second hydraulic cylinder with each other, a check valve arranged on the communication line to prevent a flow of pressure oil from the bottom chamber of the second hydraulic cylinder toward the rod chamber of the first hydraulic cylinder, and a selector valve for feeding pressure oil in the rod chamber of the first hydraulic cylinder to the bottom chamber of the second hydraulic cylinder via the communication line.

According to the present invention constructed as described immediately above, when the stroke of the second control device has increased to at least the predetermined amount upon performing a combined operation of these first hydraulic cylinder and second hydraulic cylinder by feeding pressure oil from the main hydraulic pump to the bottom chambers of the first hydraulic cylinder and second hydraulic cylinder, respectively, the selector valve is switched to maintain the communication line in a communicating state, and as a result, the pressure oil in the rod chamber of the first hydraulic cylinder is fed to the bottom chamber of the second hydraulic cylinder via the communication line and check valve. Described specifically, the pressure oil fed to the bottom chamber of the second hydraulic cylinder via the second directional control valve and the pressure oil fed from the rod chamber of the first hydraulic cylinder are combined and fed to the bottom chamber of the second hydraulic cylinder, and as a result, an acceleration can be achieved in the extending direction of the second hydraulic cylinder.

When the stroke of the second control device is so small that it does not reach the predetermined amount upon performing a combined operation of the first hydraulic cylinder and second hydraulic cylinder as mentioned above, the selector valve is held to communicate the communication line with the reservoir, and a result, the pressure oil in the rod chamber of the first hydraulic cylinder is drained into the reservoir. In this case, to the bottom chamber of the second hydraulic cylinder, pressure oil is fed only via the second directional control valve so that no acceleration is achieved in the extending direction of the second hydraulic cylinder.

The present invention can also be characterized in that in the above-described invention, the selector valve may include a variable restrictor.

According to the present invention constructed as described immediately above, the opening of the variable restrictor included in the selector valve changes depending upon the stroke of the second control device. Described specifically, when the stroke of the second control device is relatively small although it is equal to or greater than the predetermined amount, the opening of the variable restrictor in the selector valve becomes smaller so that the flow rate of pressure oil from the rod chamber of the first hydraulic cylinder, which is to be fed to the communication line via the variable restrictor, is reduced. When the stroke of the second control device is equal to or greater than the predetermined amount and is relatively large, on the other hand, the opening of the variable restrictor in the selector valve becomes large so that the flow rate of pressure oil from the rod chamber of the first hydraulic cylinder, which is to be fed to the communication line via the variable restrictor, can be increased.

The present invention can also be characterized that the above-described invention may further comprise a branch line connected at an end thereof to a main line, which connects the first directional control valve and the rod chamber of the first hydraulic cylinder with each other, and at an opposite end thereof to the selector valve.

According to the present invention constructed as described immediately above, when the stroke of the second control device has increased to at least the predetermined amount upon performing a combined operation of these first hydraulic cylinder and second hydraulic cylinder, the pressure oil in the rod chamber of the first hydraulic cylinder is fed to the bottom chamber of the second hydraulic cylinder from the communication line without going through the first directional control valve. It is, therefore, possible to reduce a pressure loss compared with feeding the pressure oil through the first directional control valve insofar as the diameter of the branch line is set sufficiently large.

The present invention can also be characterized in that the above-described invention may further comprise a stroke detector for detecting a stroke of the second control device and outputting an electrical signal, and a controller for outputting, responsive to the signal outputted from the stroke detector, a control signal to selectively control the selector valve.

According to the present invention constructed as described immediately above, when it is detected by the stroke detector that the stroke of the second control device has increased to at least the predetermined amount, the electrical signal outputted from the stroke detector is inputted to the controller. As a result, a control signal for switching the selector valve is outputted from the controller so that the selector valve is switched to maintain the communication line in the communicating state. The pressure oil in the rod chamber of the first hydraulic cylinder is, therefore, fed to the bottom chamber of the second hydraulic cylinder via the communication line and check valve.

The present invention can also be characterized in that in the above-described invention, the controller may include a function generator for outputting a value which becomes gradually greater as the stroke of the second control device increases.

According to the present invention constructed as described immediately above, a value which becomes gradually greater as the stroke of the second control device increases is determined at the function generator, and a control signal corresponding to the thus-determined value is outputted from the controller to control the amount of switching of the selector valve. It is, therefore, possible to control the speed of the second hydraulic cylinder which is in a state accelerated corresponding to the stroke of the second control device.

The present invention can also be characterized in that in the above-described invention, the selector valve may be a pilot-controlled selector valve, and the hydraulic drive system may be provided with an electric-hydraulic converter for outputting a control pressure corresponding to the control signal outputted from the controller and a control line communicating the electric-hydraulic converter and the pilot-controlled selector valve with each other.

According to the present invention constructed as described immediately above, when a control signal outputted from the controller is fed to the electric-hydraulic converter, a pilot pressure corresponding to the value of the control signal is applied from the electric-hydraulic converter to the control chamber of the pilot-controlled selector valve via the control line so that the amount of switching of the selector valve is controlled depending upon the level of the pilot pressure.

The present invention can also be characterized in that in the above-described invention, the first hydraulic cylinder and second hydraulic cylinder may comprise a boom cylinder and arm cylinder, respectively, the first directional control valve and second directional control valve may comprise a center-bypass-type, directional control valve for a boom and directional control valve for an arm, respectively, and the first control device and second control device may comprise a boom control device and arm control device, respectively.

According to the present invention constructed as described immediately above, when the stroke of the arm control device has increased to at least the predetermined amount upon performing a combined operation of the boom cylinder and arm cylinder by controlling the boom control device and arm control device to switch the directional control valve for the boom and the directional control valve for the arm and feeding pressure oil from the main hydraulic pump to the bottom chambers of these boom cylinder and arm cylinder via the directional control valve for the boom and the directional control valve for the arm, that is, upon performing a combined operation of boom raising and arm crowding, the communication control means is actuated such that the pressure oil in the rod chamber of the boom cylinder is fed to the bottom chamber of the arm cylinder. Described specifically, the pressure oil delivered from the main hydraulic pump and fed via the directional control valve for the arm and the pressure oil fed from the rod chamber of the boom cylinder are combined and fed to the bottom chamber of the arm cylinder, and as a result, an acceleration in the extending direction of the arm cylinder, that is, an acceleration in arm crowding can be realized.

According to the invention constructed as described immediately above, upon performing a combined operation by feeding oil pressure to the bottom chambers of the first hydraulic cylinder and second hydraulic cylinder, respectively, the pressure oil in the rod chamber of the first hydraulic cylinder, which was conventionally drained into the reservoir, can be effectively used depending upon the stroke of the second control device, which controls the second hydraulic cylinder, irrespective of the level of the bottom pressure of the second hydraulic cylinder, and compared with the conventional art, it is thus possible to perform more work with effective use of pressure oil.

BRIEF DESCRIPTION OF THE DRAWINGS

FIG. 5 is a diagram illustrating the construction of an essential part of a controller which the third embodiment shown in FIG. 4 is provided with.

BEST MODES FOR CARRYING OUT THE INVENTION

Best modes for carrying out the hydraulic drive system according to the present invention will hereinafter be described based on the drawings.

Figure 1:
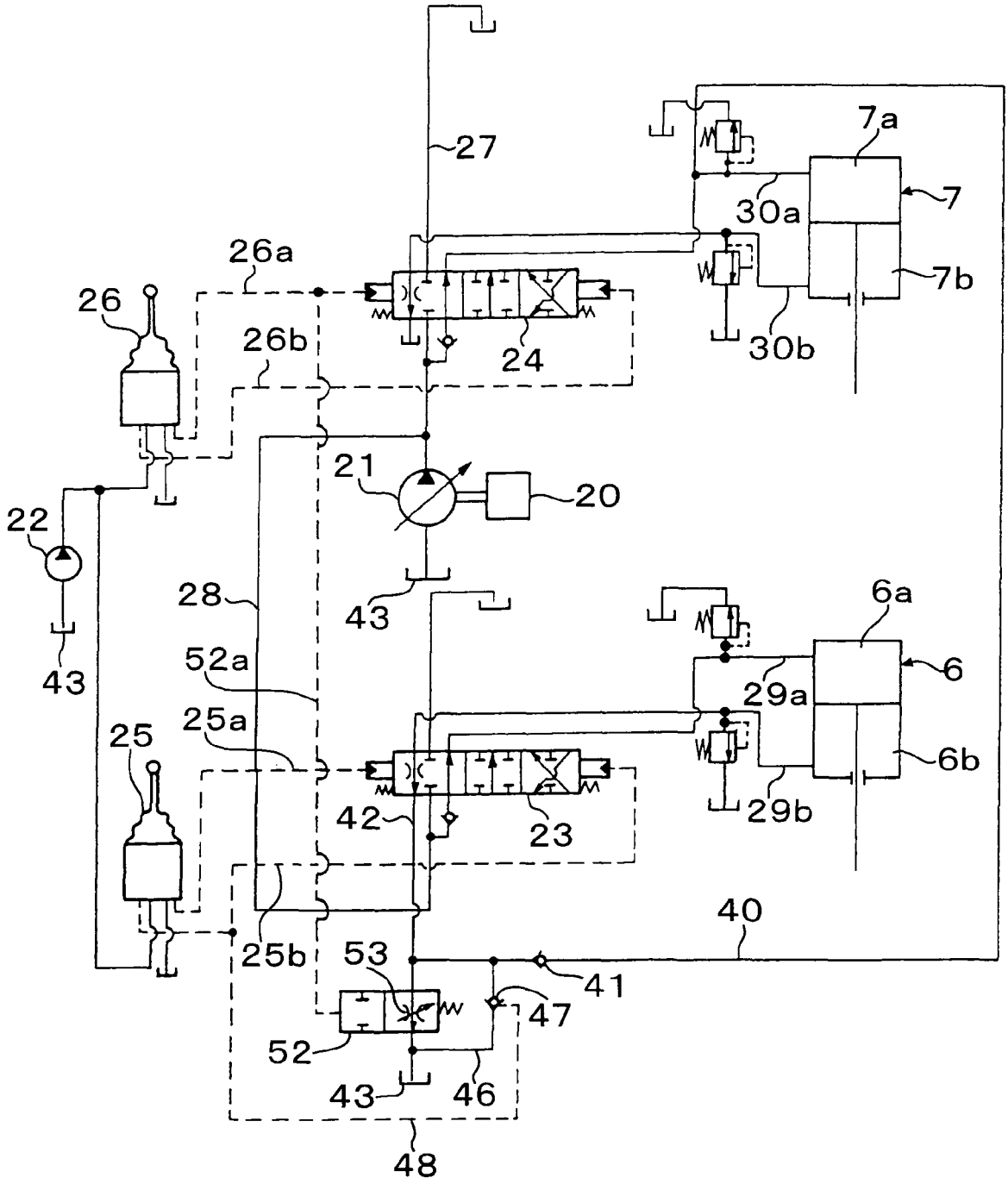
FIG. 1 is a hydraulic circuit diagram showing a first embodiment of the hydraulic drive system according to the present invention.

FIG. 1 is a circuit diagram showing the first embodiment of the hydraulic drive system according to the present invention.

Not only the first embodiment shown in FIG. 1 but also the second and third embodiments to be described subsequently herein are arranged on construction machines, for example, on hydraulic excavators, and each comprises a hydraulic drive system of the center bypass type for driving, for example, a boom cylinder 6 as a first hydraulic cylinder and an arm cylinder 7 as a second hydraulic cylinder. The boom cylinder 6 is provided with a bottom chamber 6*a* and a rod chamber 6*b*, and the arm cylinder 7 is likewise provided with a bottom chamber 7*a* and a rod chamber 7*b*.

The first embodiment is also provided with an engine 20, a main hydraulic pump 21 and pilot pump 22 driven by the engine 20, a first directional control valve for controlling a flow of pressure oil to be fed to the boom cylinder 6, i.e., a center-bypass-type directional control valve 23 for the boom, a second directional control valve for controlling a flow of pressure oil to be fed to the arm cylinder 7, i.e., a center-bypass-type directional control valve 24 for the arm. Also provided are a first control device for selectively controlling the directional control valve 23 for the boom, i.e., a boom control device 25 and a second control device for selectively controlling the directional control valve 24 for the arm, i.e., an arm control device 26.

Lines 27,28 are connected to a delivery line of the main hydraulic pump 21, the directional control valve 24 for the arm is arranged on the line 27, and the directional control valve 23 for the boom is arranged on the line 28.

The directional control valve 23 for the boom and the bottom chamber 6*a* of the boom cylinder 6 are connected via a main line 29*a*, while the directional control valve 23 for the boom and the rod chamber 6*b* of the boom cylinder 6 are connected via a main line 29*b*. The directional control valve 24 for the arm and the bottom chamber 7*a* of the arm cylinder 7 are connected via a main line 30*a*, while the directional control valve 24 for the arm and the rod chamber 7*b* of the arm cylinder 7 are connected via a main line 30*b*.

The boom control device 25 and arm control device 26 are composed, for example, of pilot control devices which produce pilot pressures, and are connected to the pilot pump 22. Further, the boom control device 25 is connected to control chambers of the directional control valve 23 for the boom via pilot lines 25*a*, 25*b*, respectively, while the arm control device 26 is connected to control chambers of the directional control valve 24 for the arm via pilot lines 26*a*, 26*b*, respectively.

This first embodiment is provided with a communication control means for communicating the rod chamber 6*b* of the boom cylinder 6, which makes up the first hydraulic cylinder, and the bottom chamber 7*a* of the arm cylinder 7, which makes up the second hydraulic cylinder, with each other especially when the stroke of the arm control device as the second control device has increased to a predetermined amount S or greater.

As shown by way of example in FIG. 1, this communication control means comprises a communication line 40 capable of communicating the rod chamber 6*b* of the boom cylinder 6 and the bottom chamber 7*a* of the arm cylinder 7 with each other, a check valve 41 arranged on the communication line 40 to prevent a flow of pressure oil from the bottom chamber 7*a* of the arm cylinder 7 toward the rod chamber 6*b* of the boom cylinder 6, and a selector valve 52 for feeding pressure fluid in the rod chamber 6*b* of the boom cylinder 6 to the bottom chamber 7*a* of the arm cylinder 7 via the communication line 40 when the stroke of the arm control device 26 has increased to the predetermined amount S or greater. This selector valve 52 comprises a pilot control device which is switched by an arm pilot pressure guided via a control line 52*a* connected to the pilot line 26*a*.

Also arranged are a line 46 connected at an end thereof to the part of the communication line 40 located on an upstream side of the check valve 41 and at an opposite end thereof to a reservoir 43, and a pilot-controlled check valve 47 arranged on the line 46 such that responsive to a predetermined control of the boom control device as the first control device, for example, an operation to feed pressure oil to the pilot line 25*b* to perform boom lowering, the line 46 is opened. The above-described pilot line 25*b* and pilot-controlled check valve 47 are connected together by a control line 48.

In the first embodiment constructed as described above, combined operations of the boom cylinder 6 and the arm cylinder 7 are performed as will be described hereinafter.

[Combined Operation of Boom Raising and Arm Crowding]

When the boom control device 25 is controlled to feed a pilot pressure to the pilot line 25*a* such that the directional control valve 23 for the boom is switched into the left position as shown in FIG. 1 and further, the arm control device 26 is controlled to feed a pilot pressure to the pilot line 26*a* such that the directional control valve 24 for the arm is switched into the left position as shown in FIG. 1, pressure oil delivered from the main hydraulic pump 21 is fed to the bottom chamber 6*a* of the boom cylinder 6 via the line 28, the directional control valve 23 for the boom and the main line 29*a*, and further, the pressure oil delivered from the main hydraulic pump 21 is also fed to the bottom chamber 7*a* of the arm cylinder 7 via the line 27, the directional control valve 24 for the arm and the main line 30*a*. As a result, the boom cylinder 6 and arm cylinder 7 are both operated in extending directions to perform a combined operation of boom raising and arm crowding.

During the above-described combined operation, the pilot line 25*b* of the boom operating system is not fed with the pilot pressure, and remains under the same pressure as the reservoir pressure. Therefore, the control line 48 takes the reservoir pressure so that the pilot-controlled check valve 47 remains in a closed position to prevent communication between the communication line 40 and the reservoir 43 via the line 46.

In a state that the stroke of the arm control device 26 is smaller than the predetermined amount S, the force of an arm pilot pressure corresponding to the is smaller than the spring force of the selector valve 52, and therefore, this selector valve 52 is held in the right position shown in FIG. 1. In this state, the rod chamber 6*b* of the boom cylinder 6 is in communication with the reservoir 43 via the main line 29*b*, the directional control valve 23 for the boom, the reservoir line 42, and the selector valve 52. During an extending operation of the boom cylinder 6, the pressure oil in the rod chamber 6*b* of the boom cylinder 6 is, therefore, returned to the reservoir 43, and the pressure oil in the rod chamber 6*b* is not fed to the communication line 40.

Figure 2:
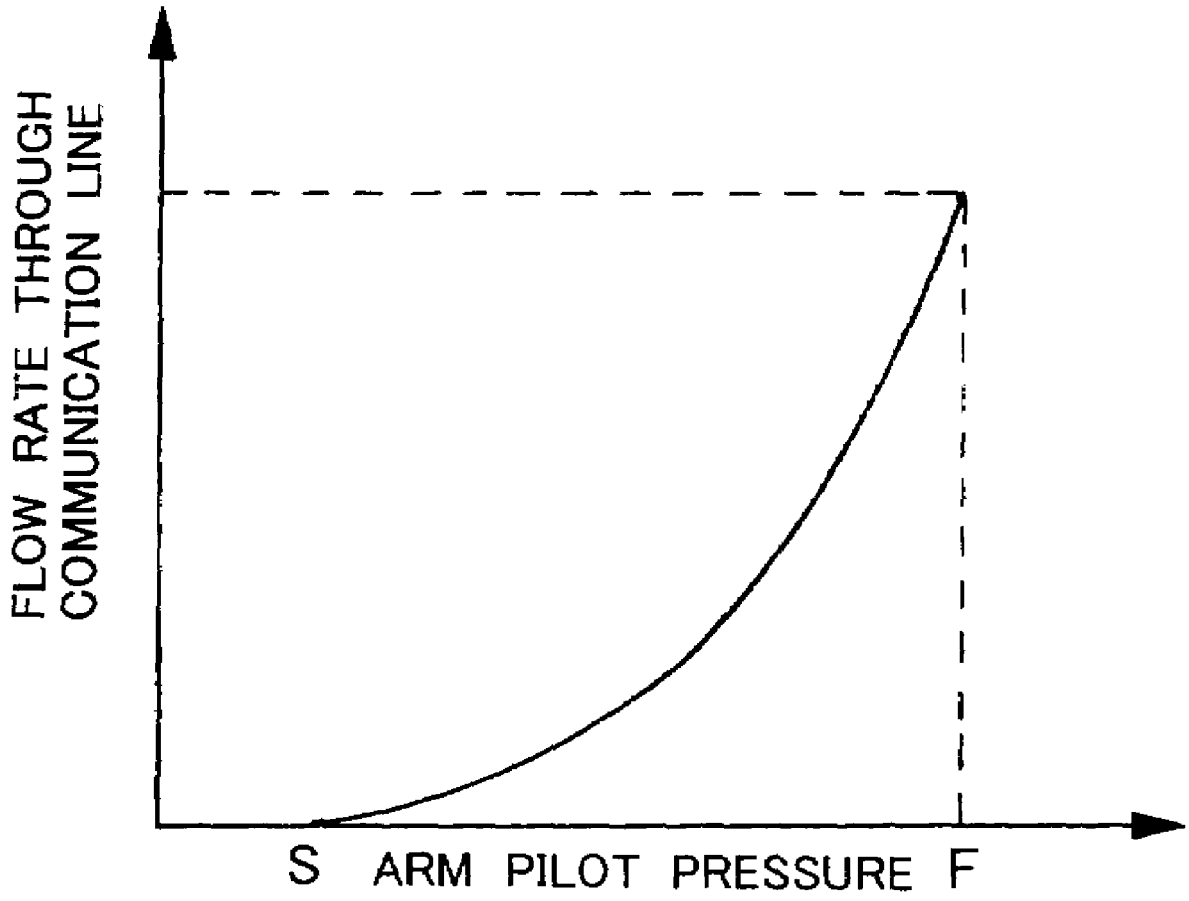
FIG. 2 is a characteristic diagram illustrating a relation between an arm pilot pressure and a flow rate through a communication line, which is available in the first embodiment shown in FIG. 1.

When the stroke of the arm control device 26 increases to the predetermined amount S or greater from such a state as described above, the force produced by an arm pilot pressure guided corresponding to the stroke via the control line 52*a* becomes greater than the spring force of the selector valve 52 so that the selector valve 52 tends to be switched toward the left position in FIG. 1. When this state is established, the reservoir line 42 begins to be closed by the selector valve 52 so that a predetermined portion of the pressure oil, which has been guided from the rod chamber 6*b* of the boom cylinder 6 into the main line 29*b*, the directional control valve 23 for the boom and the reservoir line 42, is fed to the communication line 40 via the check valve 41. As illustrated in FIG. 2, the flow rate at which the predetermined portion of the pressure oil is fed at this time increases with the arm pilot pressure which corresponds to the stroke of the arm control device 26. It is to be noted that in FIG. 2, "S" indicates the above-mentioned predetermined stroke and "F" indicates the stroke at the time of a full stroke. The pressure oil fed to the communication line 40 is fed to the bottom chamber 7*a* of the arm cylinder 7 via the main line 30*a*. Described specifically, the pressure oil delivered from the main hydraulic pump 21 and fed via the directional control valve 24 for the arm and the pressure oil fed from the rod chamber 6*b* of the boom cylinder 6 are combined and fed to the bottom chamber 7*a* of the arm cylinder 7. As a result, an acceleration of the arm cylinder 6 in the extending direction can be realized. In other words, the operating speed of arm crowding can be rendered faster.

[Combined Operation of Boom Lowering and Arm Crowding]

When the boom control device 25 is controlled to feed a pilot pressure to the pilot line 25*b* such that the directional control valve 23 for the boom is switched into the right position shown in FIG. 1 and further, the arm control device 26 is controlled to feed a pilot pressure to the pilot line 26*a* such that the directional control valve 24 for the arm is switched into the left position, pressure oil delivered from the main hydraulic pump 21 is fed to the rod chamber 6*b* of the boom cylinder 6 via the line 28, the directional control valve 23 for the boom and the main line 29*b*, and as mentioned above, the pressure oil delivered from the main hydraulic pump 21 is also fed to the bottom chamber 7*a* of the arm cylinder 7 via the line 27, the directional control valve 24 for the arm and the main line 30*a*. As a result, the boom cylinder 6 is operated in a retracting direction and the arm cylinder 7 is operated in the extending direction so that a combined operation of boom lowering and arm crowding is performed.

As the pilot pressure is being fed to the pilot line 25*b* in the boom operating system during such a combined operation, a control pressure is guided into the control line 48 so that the pilot-controlled check valve 47 is operated to open the line 46. As a result, the part of the communication line 40 on the upstream side of the selector valve 52 is brought into communication with the reservoir 43.

When the stroke of the second control device 26 increases to the predetermined amount S or greater, the selector valve 52 tends to be switched toward the left position in FIG. 1 as mentioned above. The part of the communication line 40 is, however, in communication with the reservoir 43 via the pilot-controlled check valve 47 and the line 46 as mentioned above. Consequently, the bottom chamber 6*a* of the boom cylinder 6 is brought into a state communicated with the reservoir 43.

In this state, the pressure oil in the bottom chamber 6*a* of the boom cylinder 6 is returned to the reservoir 43 via the main line 29*a* and the directional control valve 23 for the boom. The pressure oil in the bottom chamber 6*a* of the boom cylinder 6 is, therefore, not fed to the bottom chamber 7*a* of the arm cylinder 7 via the communication line 40 so that no acceleration is performed in arm crowding.

Upon performing a combined operation including arm dumping in which pressure oil is fed to the rod chamber 7*b* of the arm cylinder 7, the bottom chamber 7*a* of the arm cylinder 7 is brought into communication with the reservoir 43. No pressure is, therefore, developed in the communication line 40 so that no acceleration of the arm cylinder 7 is performed.

In the first embodiment constructed as described above, during a combined operation of boom raising and arm crowding, the pressure oil in the rod chamber 6*a* of the boom cylinder 6 can be combined to the bottom chamber 7*a* of the arm cylinder 7 as a result of a control of the second control device 26 irrespective of the level of the bottom pressure in the arm cylinder 7. This makes it possible to effectively use the pressure oil in the rod chamber 6*a* of the boom cylinder 6, the pressure oil having heretofore been simply drained into the reservoir 43, for the acceleration of the arm cylinder 7 and hence, to achieve an improvement in the efficiency of the work. It is possible to improve the efficiency of work, for example, not only in digging work of earth that the pressure in the bottom chamber 7*a* of the arm cylinder 7 becomes higher but also in work by a crowding control of a bucket in the air that the pressure in the bottom chamber 7*a* of the arm cylinder 7 becomes lower. As a result, it is possible to accelerate any work that can effectively use the pressure oil in the rod chamber 6*a* of the boom cylinder 6.

Even when the stroke of the arm control device 26 is the predetermined amount S or greater, an acceleration of the arm cylinder 7, in other words, an acceleration of the operating speed of arm crowding can be reduced by opening the pilot-controlled check valve 47 when boom lowering which requires retraction of the boom cylinder 6 is performed. It is, therefore, possible to continue the desired working performance by combined operations of boom lowering and arm crowding.

Figure 3:
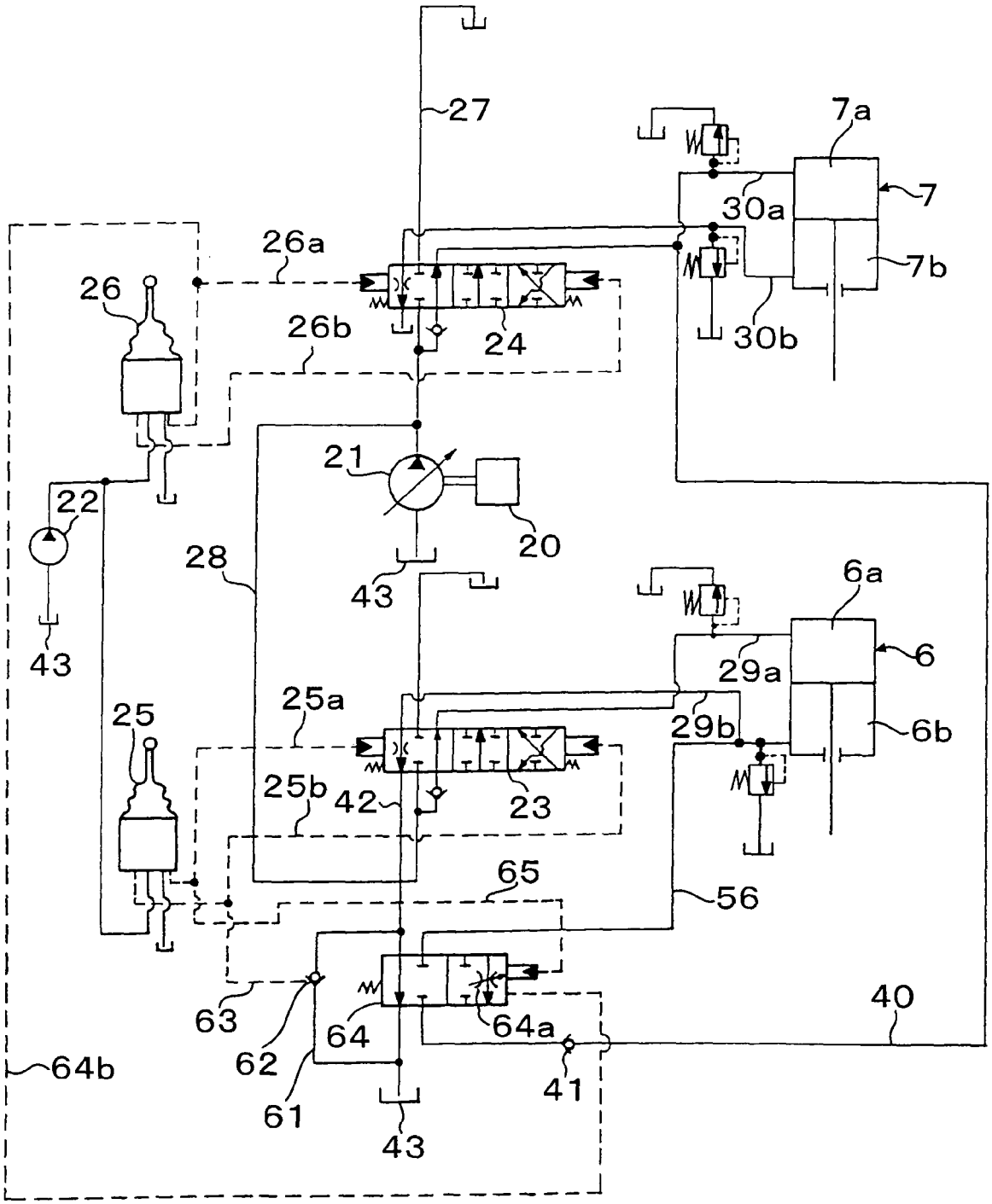
FIG. 3 is a hydraulic circuit diagram showing a second embodiment of the present invention.

FIG. 3 is a hydraulic circuit diagram showing a second embodiment of the present invention.

This second embodiment is provided with a branch line 56, which is connected at an end thereof to the main line 29*b* communicating the directional control valve 23 for the boom and the rod chamber 6*b* of the boom cylinder 6 with each other, and at an opposite end thereof to a selector valve 64 which constitutes the communication control means. The selector valve 64 has a variable restrictor 64*a*, is arranged on a reservoir line 42, and is interposed at a point of connection between the branch line 56 and the communication line 40.

The second embodiment is also provided with a bypass line 61, a pilot-controlled check valve 62 arranged on the bypass line 61, and a control line 63 connected at an end thereof to the pilot line 25*b* in the boom control system and at an opposite end thereof to the pilot-controlled check valve 62. The bypass line 61 communicates a part of the reservoir line 42, said part being located on an upstream side of the selector valve 64, and another part of the reservoir line 42, said part being located on a downstream side of the selector valve 64, with each other.

A control chamber, which is arranged opposite a spring case of the selector valve 64, and the pilot line 26*a* in the arm control system, are connected with each other by a control line 64*b*. Further, the control chamber, which is arranged opposite the spring case of the selector valve 64, and the pilot line 25*a* in the boom control system, are connected with each other by a control line 65. The remaining construction is similar to that in the above-described first embodiment.

In this second embodiment, where the stroke of the boom control device 25 is relatively small when upon performing a combined operation of boom raising and arm crowding, the stroke of the arm control device 26 has increased to the predetermined amount S or greater and the selector valve 64 is about to be switched into the right position, a control pressure to be fed to the control chamber of the selector valve 64 via the pilot line 25*a* and control line 65 as a result of the control of the boom control device 25 is relatively low, and as a result, the amount of switching of the selector valve 64 is small, the opening of the variable restrictor 64*a* included in the selector valve 64 becomes relatively small. Through this reduced opening, the pressure oil in the rod chamber 6*b* of the boom cylinder 6 can be fed at a relatively low flow rate to the bottom chamber 7*a* of the arm cylinder 7 via the branch line 56, the variable restrictor 64*a* of the selector valve 64, the check valve 41 and the communication line 40. As a consequence, the speed of the arm cylinder 7 which is in an accelerated state can be made relatively slow.

Where the stroke of the boom control device 25 is relatively large, the control pressure to be fed to the control chamber of the selector valve 64 via the control line 65 as a result of the control of the boom control device 25 becomes higher, and as a result, the opening of the variable restrictor 64*a* in the selector valve 64 becomes large. Through this enlarged opening, the pressure oil in the rod chamber 6*b* of the boom cylinder 6 can be fed at a high flow rate to the bottom chamber 7*a* of the arm cylinder 7. As a consequence, the speed of the arm cylinder 7 which is in an accelerated state can be made still faster.

When upon performing a combined operation of boom lowering and arm crowding, the stroke of the arm control device 26 has increased to the predetermined amount S or greater and the selector valve 64 becomes prone to be switched into the right position in FIG. 3 and further, the boom control device 25 is controlled and a control pressure is applied to the pilot-controlled variable restrictor 62 via the pilot line 25*b* and control line 63, the pilot-controlled variable restrictor 62 is opened, the pressure oil in the bottom chamber 6*a* of the boom cylinder 6 is returned to the reservoir 43 via the main line 29*a*, the directional control valve 23 for the boom, the reservoir line 42, the line 61 and the pilot-controlled check valve 62. It, therefore, becomes possible to perform the desired retracting operation of the boom cylinder 6, namely, the boom lowering operation.

Even when during such a combined operation of boom lowering and arm crowding, the stroke of the arm control device 26 has increased to the predetermined amount S or greater and the selector valve 64 tends to be switched into the right position in FIG. 3, the bypass line 25*a* in the boom control system is brought to the reservoir pressure, the control line 65 is also brought to the reservoir pressure, and therefore, the variable restrictor 64*a* in the selector valve 64 is closed. As a consequence, the pressure oil in the rod chamber 6*b* of the boom cylinder 6 is not combined into the bottom chamber 7*a* of the arm cylinder 7.

According to the second embodiment constructed as described above, the pressure oil in the rod chamber 6*a* of the boom cylinder 6, as in the above-described first embodiment, can be combined into the bottom chamber 7*a* of the arm cylinder 7 irrespective of the level of the bottom pressure of the arm cylinder 7 as a result of a control of the second control device 26 upon performing a combined operation of boom raising and arm crowding. In particular, it is also possible to control the flow rate through the communication line, that is, the acceleration of the arm cylinder 7 by relying upon the stroke of the boom control device 25 which controls the boom cylinder 6.

When the stroke of the arm control device 26 has increased to the predetermined amount S or greater in the combined operation of the boom raising and arm crowding, the pressure oil in the rod chamber 6*b* of the boom cylinder 6 is fed from the communication line 40 to the bottom chamber 7*a* of the arm cylinder 7 via the branch line 56, that is, without going through the directional control valve 23 for the boom. Compared with the feeding of the pressure oil through the directional control valve 23 for the boom, it is, therefore, possible to reduce the pressure loss and hence, the energy loss provided that the diameter of the branch line 56 is set sufficiently large.

Figure 4:
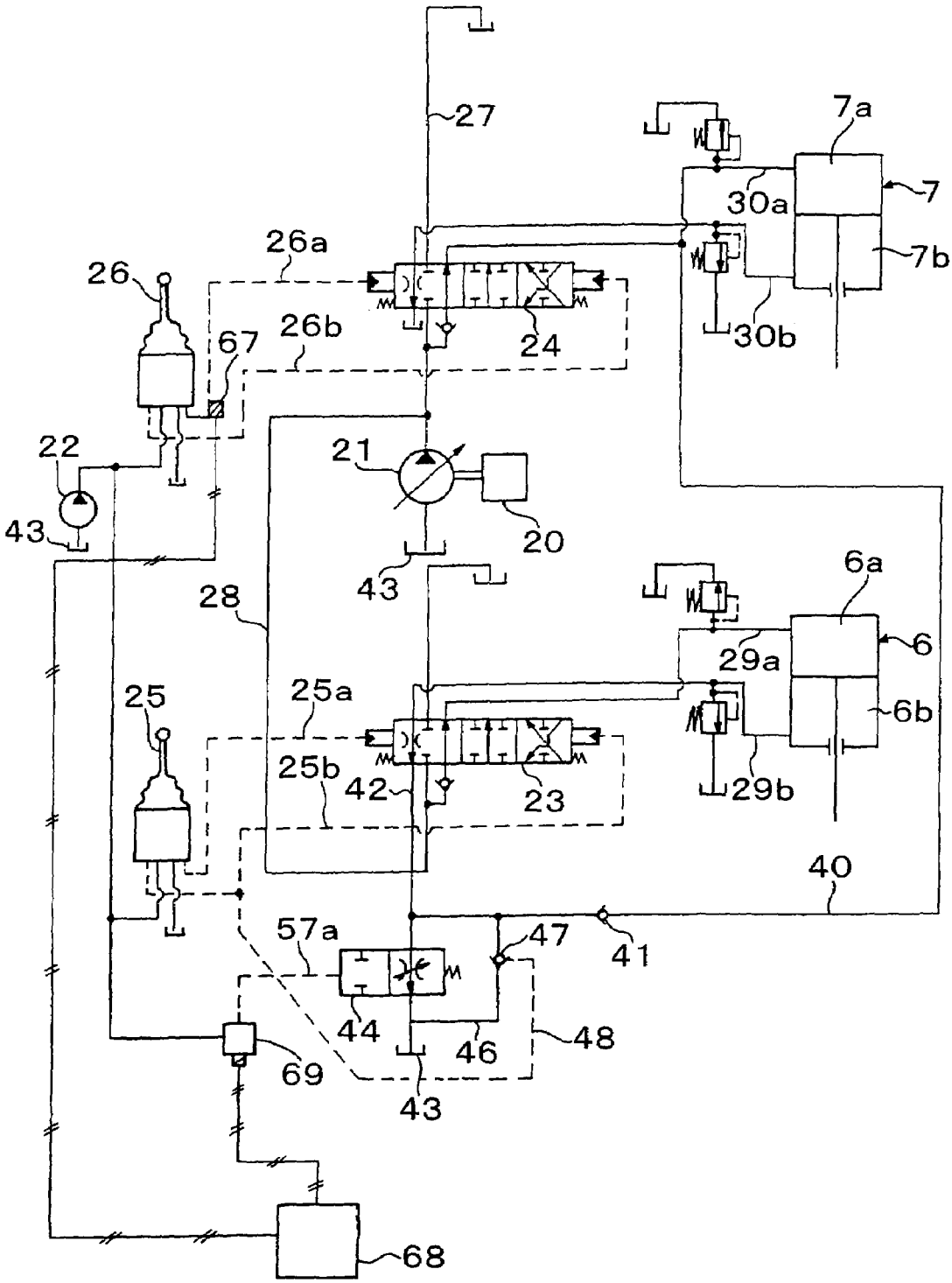
FIG. 4 is a hydraulic circuit diagram showing a third embodiment of the present invention.
Figure 5:
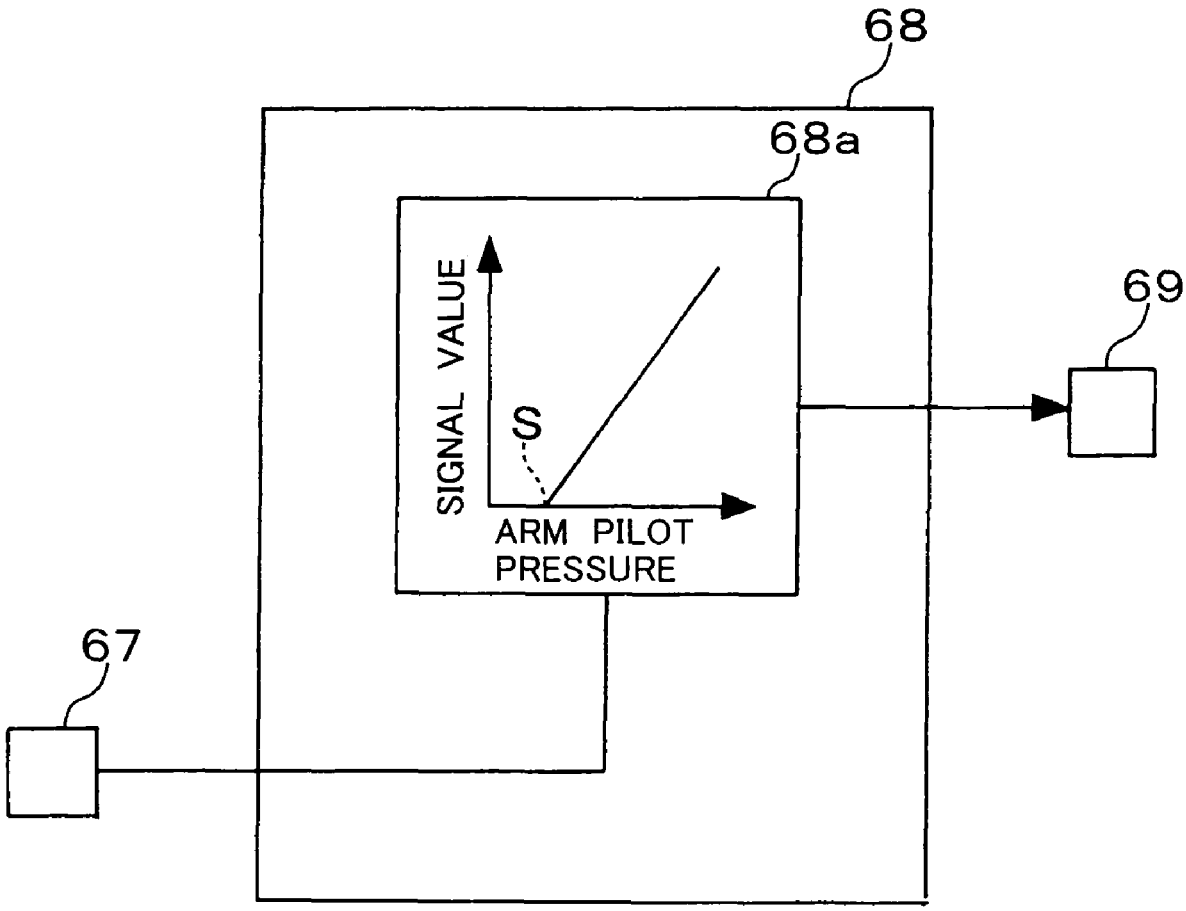

FIG. 4 is a hydraulic circuit showing a third embodiment of the present invention, and FIG. 5 is a diagram illustrating the construction of an essential part of a controller which the third embodiment shown in FIG. 4 is provided with.

The third embodiment shown in these FIGS. 4 and 5 is constructed that a communication control means for communicating the rod chamber 6*b* of the boom cylinder as the first hydraulic cylinder and the bottom chamber 7*a* of the arm cylinder 7 with each other when the stroke of the arm control device 26 as the second control device has increased the predetermined amount S or greater is arranged on the pilot line 26*a*, and that the third embodiment includes a stroke detector, i.e., an arm pilot pressure detector 67 for detecting an arm pilot pressure, which corresponds to the stroke of the arm control device 26, and outputting an electrical signal, a controller 68 for outputting a control signal to selectively control a selector valve 44 responsive to the signal outputted from the arm pilot pressure detector 67, an electric-hydraulic converter 69 for outputting a control pressure corresponding to the value of the control signal outputted from the controller 68, and a control line 57*a* communicating the electric-hydraulic converter 69 and the control chamber of the selector valve 44 with each other. As illustrated in FIG. 5, the controller 68 includes a function generator 68*a* for outputting a value which becomes gradually greater as the arm pilot pressure corresponding to the stroke of the arm control device 26 increases. The remaining elements of the construction are similar to the corresponding elements in the above-described first embodiment shown in FIG. 1.

According to the third embodiment constructed as described above, especially when upon performing a combined operation of boom raising and arm crowding, the boom control device 25 is controlled to feed a pilot pressure to the pilot line 25*a* and to switch the directional control valve 23 into the left position and the arm control device 26 is controlled to feed a pilot pressure to the pilot line 26*a* and to switch the directional control valve 24 for the arm into the left position, as illustrated in FIG. 4, the pressure oil delivered from the main hydraulic pump 1 is fed to the bottom chamber 6*a* of the boom cylinder 6 and the bottom chamber 7*a* of the arm cylinder 7. As a result, the boom cylinder 6 and arm cylinder 7 both operate in their extending directions so that the combined operation of boom raising and arm crowding is performed.

During this combined operation, the pilot pressure is not fed to the pilot line 25*b* in the boom control system so that the pilot line 25*b* is brought to the reservoir pressure. Accordingly, the control line 48 is brought to the reservoir pressure, the pilot-controlled check valve 47 is maintained in a closed state, and the communication of the communication line 40 with the reservoir 43 via the line 46 is prevented.

When the stroke of the arm control device 26 is smaller than the predetermined amount S, the signal value detected by the arm pilot pressure detector 67 is small so that the signal value outputted from the function generator 68*a* of the controller 68 shown in FIG. 5 becomes smaller. The control signal of the small value is outputted from the controller 68 to the electric-hydraulic converter 69. The electric-hydraulic converter 69 outputs a relatively low control pressure to the control line 57*a*. In this state, the force by the control pressure applied to the control chamber of the selector value 44 is smaller than the spring force so that the selector valve 44 is held in the right position depicted in FIG. 4. Accordingly, the pressure oil in the rod chamber 6*b* of the boom cylinder 6 is not fed to the communication line 40 during the extending operation of the boom cylinder 6.

When the stroke of the arm control device 26 has increased to the predetermined amount S or greater in the above state, the signal value detected by the arm pilot pressure detector 67 becomes large so that the signal value outputted from the function generator 68*a* of the controller 68 depicted in FIG. 5 becomes greater. The control signal of this large value is outputted from the controller 68 to the electric-hydraulic converter 69. Responsive to the control signal, the electric-hydraulic converter 69 outputs a high control pressure to the control line 57*a*. As a result, the force by the control pressure applied to the control chamber of the selector valve 44 becomes greater than the spring force so that the selector valve 44 tends to be switched into the left position in FIG. 4. When this state has been achieved, the reservoir line 42 is cut off by the selector valve 44 so that the pressure oil, which has been guided from the rod chamber 6*b* of the boom cylinder 6 to the main line 29*a*, the directional control valve 23 for the boom and the reservoir line 42, is fed to the communication line 40 via the check valve 41. The pressure oil fed from the communication line 40 is fed to the bottom chamber 7*a* of the arm cylinder 7 via the main line 30*a*. Described specifically, the pressure oil fed via the directional control valve 24 for the arm and the pressure oil fed from the rod chamber 6*b* of the boom cylinder 6 are combined and fed to the bottom chamber 7*a* of the arm cylinder 7. As a result, an acceleration can be realized in the extending direction of the arm cylinder 6, and therefore, the operating speed of arm crowding can be made faster.

In the third embodiment constructed as described above, as in the above-described first embodiment shown in FIG. 1, the pressure oil in the rod chamber 6*a* of the boom cylinder 6, which was conventionally drained into the reservoir 43, can also be effectively used for the acceleration of the arm cylinder 7 irrespective of the level of the bottom pressure of the arm cylinder 7, and therefore, an improvement can be realized in the efficiency of work.

Corresponding to the stroke of the arm control device 26, this third embodiment can also achieve an acceleration of the arm cylinder 7 based on the function relation in the function generator 68*a* of the controller 68 so that in conformity with the operator's control sensation, the arm cylinder 7 can be smoothly accelerated to perform an arm crowding operation.

The invention claimed is:

1. A hydraulic drive system provided with a main hydraulic pump, a first hydraulic cylinder and second hydraulic cylinder driven by pressure oil delivered from said main hydraulic pump, a first directional control valve for controlling a flow of pressure oil to be fed from said main hydraulic pump to said first hydraulic cylinder, a second directional control valve for controlling a flow of pressure oil to be fed from said main hydraulic pump to said second hydraulic cylinder, a first control device for selectively controlling said first directional control valve, and a second control device for selectively controlling said second directional control valve, wherein:

said hydraulic drive system is provided with a communication control means for communicating a rod chamber of said first hydraulic cylinder and a bottom chamber of said second hydraulic cylinder with each other irrespective of a level of pressure of a bottom chamber of said second hydraulic cylinder when a stroke of said second control device has increased to at least a predetermined amount.

2. A hydraulic drive system according to claim 1, wherein said communication control means comprises a communication line capable of communicating said rod chamber of said first hydraulic cylinder and said bottom chamber of said second hydraulic cylinder with each other, a check valve arranged on said communication line to prevent a flow of pressure oil from said bottom chamber of said second hydraulic cylinder toward said rod chamber of said first hydraulic cylinder, and a selector valve for feeding pressure oil in said rod chamber of said first hydraulic cylinder to said bottom chamber of said second hydraulic cylinder via said communication line.

3. A hydraulic drive system according to claim 2, wherein said selector valve includes a variable restrictor.

4. A hydraulic drive system according to claim 2, further comprising a branch line connected at an end thereof to a main line, which connects said first directional control valve and said rod chamber of said first hydraulic cylinder with each other, and at an opposite end thereof to said selector valve.

5. A hydraulic drive system according to claim 2, further comprising a stroke detector for detecting a stroke of said second control device and outputting an electrical signal, and a controller for outputting, responsive to the signal outputted from said stroke detector, a control signal to selectively control said selector valve.

6. A hydraulic drive system according to claim 5, wherein said controller includes a function generator for outputting a value which becomes gradually greater as said stroke of said second control device increases.

7. A hydraulic drive system according to claim 5, wherein said selector valve is a pilot-controlled selector valve, and said hydraulic drive system is provided with an electric-hydraulic converter for outputting a control pressure corresponding to the control signal outputted from said controller and a control line communicating said electric-hydraulic converter and said pilot-controlled selector valve with each other.

8. A hydraulic drive system according to claim 1, wherein said first hydraulic cylinder and second hydraulic cylinder comprise a boom cylinder and arm cylinder, respectively, said first directional control valve and second directional control valve comprise a center-bypass-type, directional control valve for a boom and directional control valve for an arm, respectively, and said first control device and second control device comprise a boom control device and arm control device, respectively.

* * * * *